US005833559A

United States Patent [19]

Appelbaum et al.

[11] Patent Number: 5,833,559

[45] Date of Patent: Nov. 10, 1998

[54] TABLE TENNIS TABLE, CONVERSION KIT AND ASSOCIATED METHOD

[76] Inventors: Richard Appelbaum; Peter J. Wilk, both of 185 West End Ave., New York, N.Y. 10023

[21] Appl. No.: 747,652

[22] Filed: Nov. 13, 1996

[51] Int. Cl.[6] ..... A63B 67/04

[52] U.S. Cl. ..... 473/496

[58] Field of Search ..... 473/113, 475, 473/496, 491; 108/77, 78, 166

[56] References Cited

U.S. PATENT DOCUMENTS

| | | | |
|---|---|---|---|
| 2,127,873 | 8/1938 | Guillou | 473/475 |
| 4,176,842 | 12/1979 | Zaldivar | 473/496 |
| 4,446,796 | 5/1984 | Wilson | 108/77 |
| 4,850,590 | 7/1989 | Lin | 473/491 |
| 4,969,645 | 11/1990 | Barbador | 473/475 |
| 5,178,385 | 1/1993 | Barbador | 473/475 |
| 5,460,365 | 10/1995 | Payne | 473/496 |
| 5,575,471 | 11/1996 | Robinson | 473/496 |

FOREIGN PATENT DOCUMENTS

| | | | |
|---|---|---|---|
| 2579899 | 10/1986 | France | 473/113 |
| 231967 | 10/1924 | United Kingdom | 473/113 |

*Primary Examiner*—Theatrice Brown

*Attorney, Agent, or Firm*—R. Neil Sudol; Henry D. Coleman

[57] ABSTRACT

A table tennis table includes a main panel having a main table length and a pair of opposing major edges. A frame is connected to the main panel to supporting the main panel in a horizontal orientation. A pair of auxiliary panels are provided with a length substantially equal to the main table length. Adjustable mounting elements on the auxiliary panels and coupled to the frame mount the auxiliary panels to the frame along the major edges. The auxiliary panels have a first orientation extending substantially perpendicularly relative to the main panel and upwardly from the main panel to form rebound surfaces. The auxiliary panels additionally have a second orientation substantially coplanar with the main panel to laterally extend a playing surface of the main panel. Braces are connected the auxiliary panels to bracing the auxiliary panels alternately in the first orientation and the second orientation.

15 Claims, 6 Drawing Sheets

TABLE TENNIS TABLE, CONVERSION KIT AND ASSOCIATED METHOD

BACKGROUND OF THE INVENTION

This invention relates to a table tennis table. More particularly, this invention relates to a table tennis table capable of conversion to different forms to enable the playing of different table tennis games. This invention also relates to a kit for converting a table tennis table to enable the playing of different kinds of table tennis games. This invention additionally relates to a method for modifying a table tennis table to assume different forms for accommodating the playing of different table tennis type games.

Table tennis has long been popular in the game rooms of America and across the world, offering recreation for novice players and intense competition among the finest. The game, however, is limited in that only two players can participate at a time, and frequent interruptions in play result when a ball is bounced out of bounds and off the table. Furthermore, there is a natural desire to seek variety in recreation, whereas the standard table tennis table is useful only for the traditional game of table tennis.

OBJECT OF THE INVENTION

It is an object of the present invention to provide a table tennis table.

More specifically, it is an object of the present invention to provide a table tennis table capable of selectively accommodating alternative games.

It is an additional object of the present invention to provide a retrofit assembly for use with standard table tennis tables, capable of selectively accommodating alternative games.

It is a further object of the present invention to provide a method of modifying a table tennis table to selectively accommodate alternative games.

These and other objects of the invention will be apparent from the drawings and descriptions herein.

SUMMARY OF THE INVENTION

A table tennis table according to the invention comprises a main panel having a main table length and a pair of opposing major edges, and a frame connected to the main panel for supporting the main panel in a horizontal orientation. A pair of auxiliary panels are provided, each having a length substantially equal to the main table length. Adjustable mounting elements are provided on the auxiliary panels and are coupled at least indirectly to the frame for mounting the auxiliary panels at least indirectly to the frame along the major edges. The auxiliary panels can be selectively positioned in different orientations. In a first orientation, the auxiliary panels extend substantially perpendicularly relative to the main panel and upwardly from the main panel to form rebound surfaces. In a second orientation, the auxiliary panels are substantially coplanar with the main panel to laterally extend a playing surface of the main panel.

The table tennis table additionally has a net with a first length and an alternate second length longer than the first length. The net can be connected to the table along a midline thereof so that the net is oriented substantially perpendicularly to the playing surface. An element may be attached to the net to hold the net in a first configuration with the first length and a second configuration with the second length.

Braces can be connected to the auxiliary panels for bracing the auxiliary panels alternately in the first orientation and the second orientation. The braces may includes legs on the auxiliary panels, where the lengths have two effective lengths. At one length, the legs support the auxiliary panels in the first orientation, and at another length, the legs support the auxiliary panels in the second orientation. The legs may include one set of legs having the one length and a different set of legs having the another length, with the legs being pivotally coupled to the auxiliary panels.

The braces may, alternatively, take the form of a slidable linkage. In that case, the adjustable mounting elements further include tension cords, each extending between the frame and one the linkage for drawing the linkage toward the frame.

The adjustable mounting elements may include a plurality of double acting hinges, each connected to the main panel and one of the auxiliary panels. Alternatively, the adjustable mounting elements include a plurality of braces, each connected at one end to the frame and at an opposite end to one of the auxiliary panels.

Where the main panel of the table tennis table is provided with a downwardly depending skirt, the adjustable mounting elements can include a plurality of brackets removably connected to the skirt. The adjustable mounting elements further include features on the auxiliary panels for cooperating with the brackets to support the auxiliary panels on the brackets. The brackets may each include an L-shaped formation, with the cooperating features on the auxiliary panels defining apertures for receiving the L-shaped formation.

The adjustable mounting elements may include componentry for mounting the auxiliary panels at least indirectly to the frame along the major edges so that the auxiliary panels have a third, storage, orientation. In the storage orientation, the auxiliary panels extend substantially perpendicularly relative to the main panel and downwardly from the main panel.

According to another embodiment of the present invention, a kit is provided for modifying a table tennis table to provide alternative games. The table tennis table includes a main panel having a main table length and a pair of opposing major edges. The table further includes a frame connected to the main panel for supporting the main panel in a horizontal orientation. The kit includes a pair of auxiliary panels, each having a length substantially equal to the main table length. The kit further includes adjustable mounting elements couplable to the auxiliary panels and at least indirectly to the frame for mounting the auxiliary panels at least indirectly to the frame along the major edges. The auxiliary panels have a first orientation extending substantially perpendicularly relative to the main panel and upwardly from the main panel to form rebound surfaces. The panels also have an alternate second orientation substantially coplanar with the main panel to laterally extend a playing surface of the main panel.

The kit may further include a net having a first length and an alternate second length longer than the first length. Componentry is provided for connecting the net to the table along a midline thereof so that the net is oriented substantially perpendicularly to the playing surface. An element may be connected to the net for maintaining the net in a first configuration with the first length and alternatively in a second configuration with the second length.

Upright supports, connectable to the auxiliary panels, may be provided in the kit for supporting the auxiliary panels alternately in the first orientation and the second orientation. The upright supports may include legs on the auxiliary panels. The legs have two effective lengths: one length for supporting the auxiliary panels in the first orientation and another length for supporting the auxiliary panels in the second orientation.

The adjustable mounting elements of the kit may include a plurality of braces, each connected at one end to the frame and at an opposite end to one of the auxiliary panels. The braces may take the form of a slidable linkage together with tension cords connectable to the frame and one linkage for drawing the linkage toward the frame.

Where the main panel of the table tennis table is provided with a downwardly depending skirt, the adjustable mounting elements of the kit include a plurality of brackets removably connectable to the skirt. The adjustable mounting elements further include features on the auxiliary panels for cooperating with the brackets to support the auxiliary panels on the brackets. Where the brackets include an L-shaped formation, the cooperating features of the auxiliary panels define apertures for receiving the L-shaped formation.

The present invention further encompasses a method for modifying a table tennis table to provide alternative games. The table tennis table includes a main panel having a main table length and a pair of opposing major edges. The table further includes a frame connected to the main panel for supporting the main panel in a horizontal orientation. In the method of modifying the table, a pair of auxiliary panels is provided, each having a length substantially equal to the main table length. The auxiliary panels are mounted at least indirectly to the frame along respective ones of the opposing major edges so that the auxiliary panels have a first orientation extending substantially perpendicularly relative to the main panel and upwardly from the main panel to form rebound surfaces. The auxiliary panels are subsequently removed from the first orientation. After removing the auxiliary panels from the first orientation, the auxiliary panels are mounted at least indirectly to the frame along respective ones of the opposing major edges so that the auxiliary panels have a second orientation substantially coplanar with the main panel, laterally extending a playing surface of the main panel.

The method additionally includes the step of removing the auxiliary panels from either the first orientation or the second orientation and subsequently mounting the auxiliary panels at least indirectly to the frame so that the auxiliary panels have a third orientation. In the third orientation, the panels extend substantially perpendicularly relative to the main panel and downwardly from the main panel to return the table tennis table to a conventional table tennis playing surface.

A table tennis table, conversion kit, and associated method according to the present invention allows a player to play a variety of table-tennis games.

DETAILED DESCRIPTION

Figure 1A:
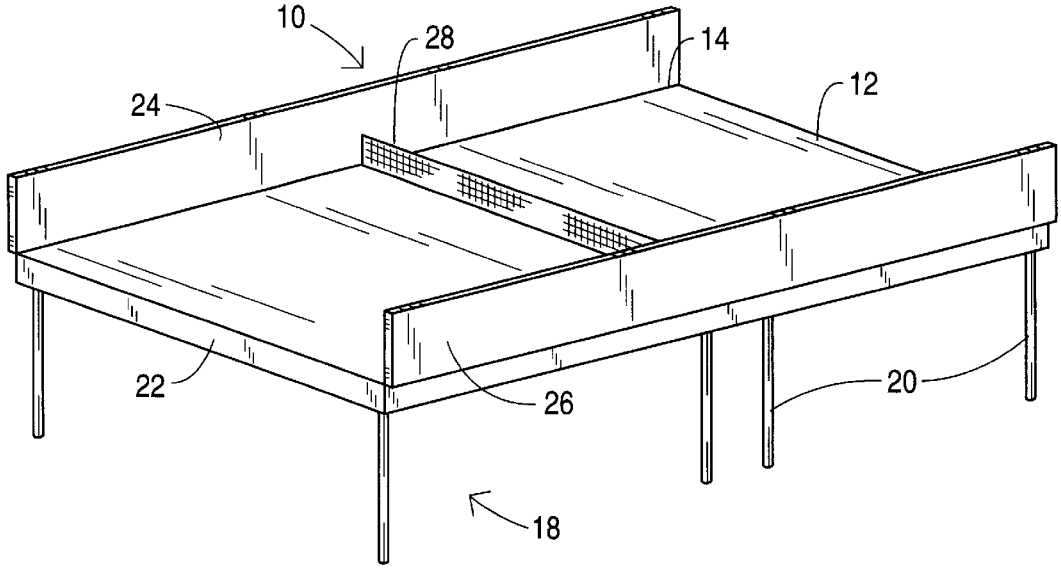
FIG. 1A is a perspective view of a table tennis table with auxiliary panels in a vertical orientation.

A table tennis table 10 includes a main panel 12 forming the upper surface of table 10. Major edges 14 and 16 of main panel 12 extend along the length of the table. Main panel 12 is supported in a horizontal orientation by a frame 18. Frame 18 includes a plurality of legs 20 and may additionally include a skirt 22 depending downwardly from the edges of main panel 12, and particularly from major edges 14 and 16. A net 28 extends across the midline of the table and stands substantially perpendicularly with respect to main panel 12.

A pair of auxiliary panels 24 and 26 are mounted on table 10 along major edges 14 and 16, respectively, of main panel 12. Each auxiliary panel 24,26 has a length substantially equal to the main table length. The auxiliary panels can be selectively positioned in different orientations. In a vertical orientation, as illustrated in FIG. 1A, the auxiliary panels 24,26 extend substantially perpendicularly upward relative to the main panel 12 to form rebound surfaces. With the auxiliary panels in the vertical orientation, players volleying a table tennis ball across the net have the option not only of bouncing the ball off of main panel 12, but also of rebounding the ball off auxiliary panels 24,26. Auxiliary panels 24,26 further serve to lessen the likelihood of the ball being struck off the side of table 10 and out of play, thus resulting in fewer interruptions than are encountered in a standard game of table tennis.

Figure 1B:
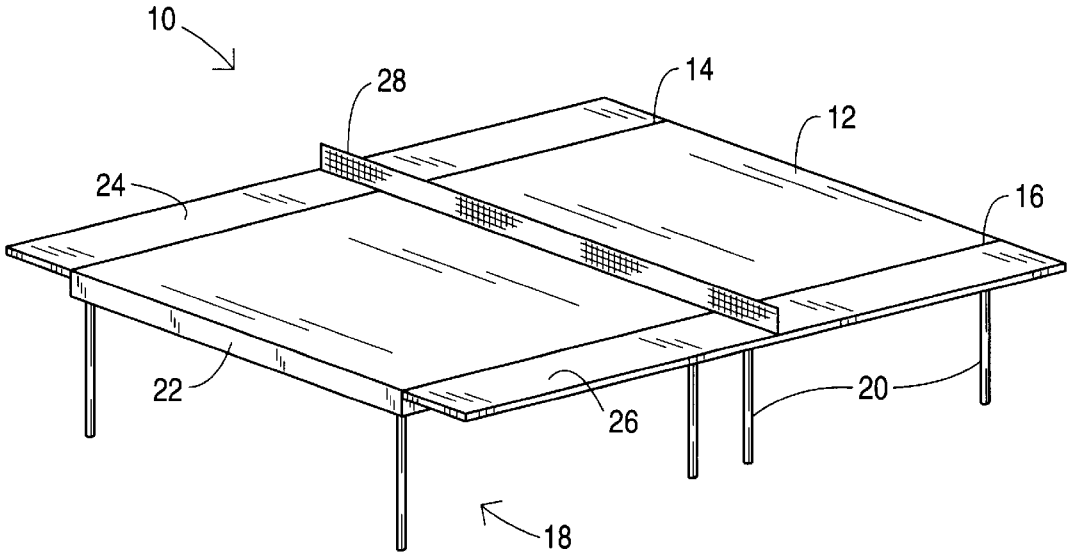
FIG. 1B is a perspective view of a table tennis table with auxiliary panels in a horizontal orientation.

In a second, horizontal orientation, illustrated in FIG. 1B, auxiliary panels 24,26 are substantially coplanar with main panel 12, thus laterally extending a playing surface of the main panel. With the playing surface extended, it is possible to play at doubles, i.e., four people can play table tennis at once, with two players to a side.

Figure 1C:
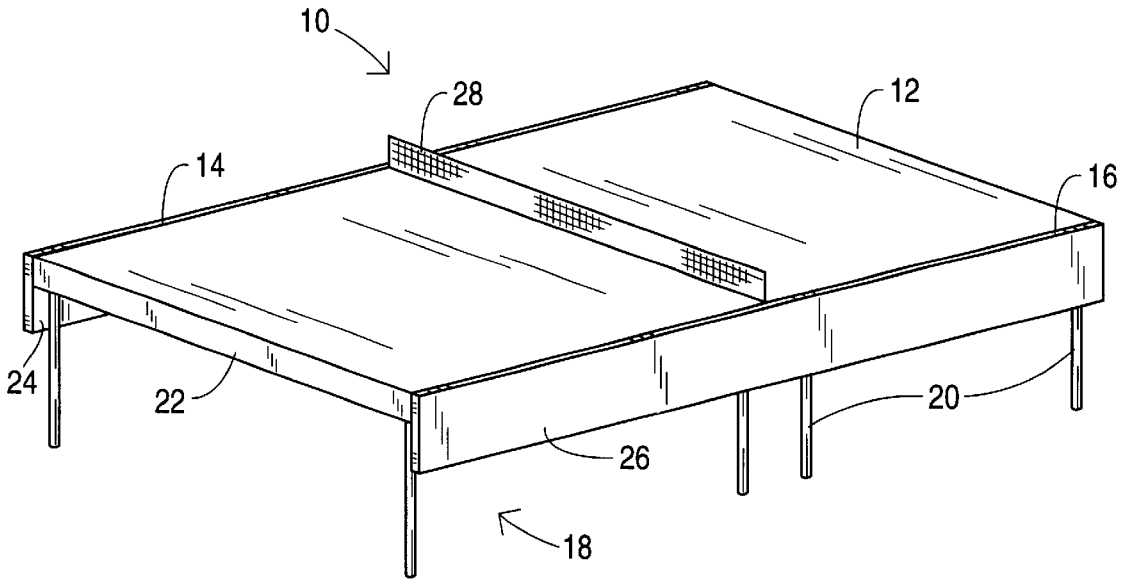
FIG. 1C is a perspective view of a table tennis table with auxiliary panels in a storage orientation.

Naturally, it may not always be desirable to play table tennis with rebound surfaces or to play at doubles table tennis. In this case, auxiliary panels 24,26 can be positioned in a third, storage orientation, as illustrated in FIG. 1C. In the storage orientation, auxiliary panels 24,26 extend substantially perpendicularly downward relative to main panel 12. In the storage orientation, auxiliary panels 24,26 do not interfere with standard table tennis play. However, the auxiliary panels are readily at hand should it be desired to move them into position for doubles play or for use as rebound surfaces.

Figure 2:
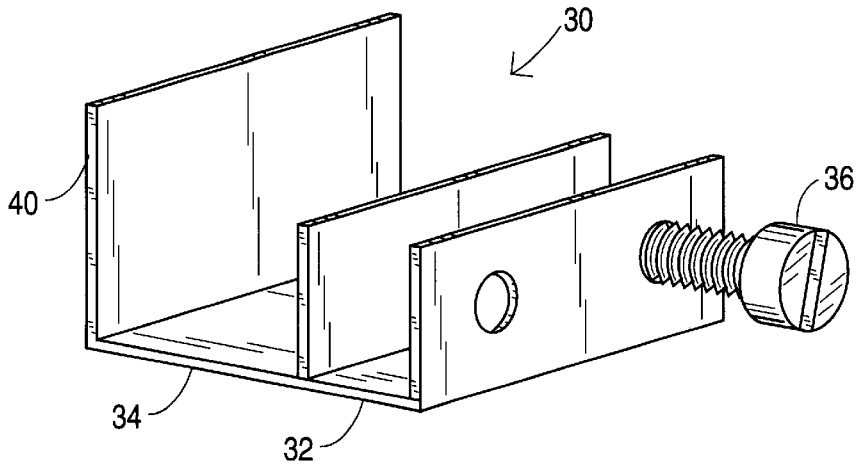
FIG. 2 is a perspective view of a mounting bracket for use in the present invention.
Figure 3A:
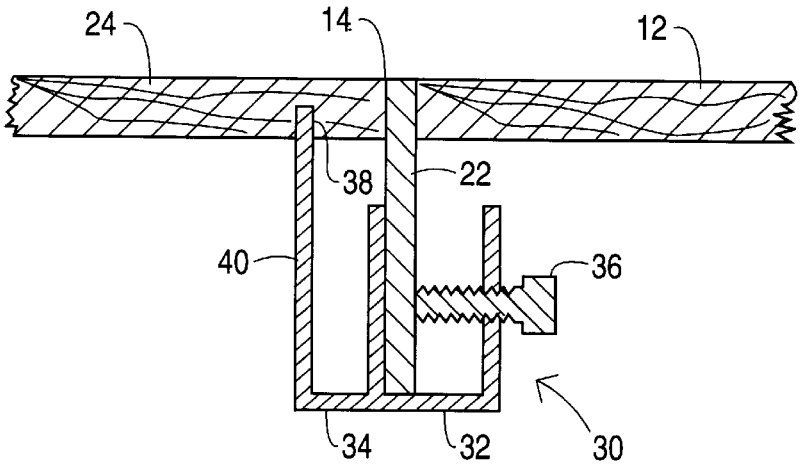
FIG. 3A is a cross-sectional view of an auxiliary panel mounted in the horizontal orientation with the mounting bracket.
Figure 3B:
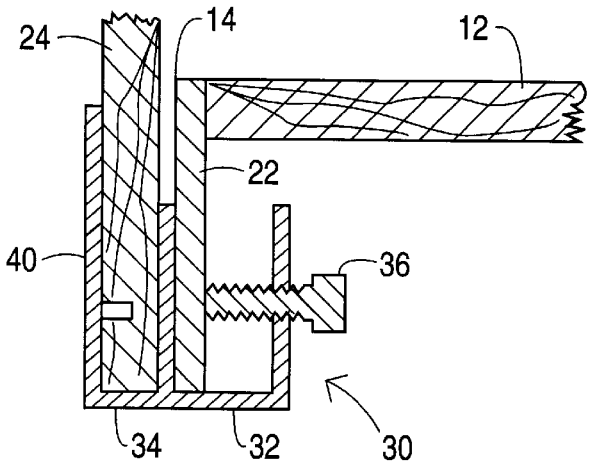
FIG. 3B is a cross-sectional view of an auxiliary panel mounted in the vertical orientation with the mounting bracket.

Auxiliary panels 24,26 are mounted either directly on frame 18 or indirectly on frame 18, e.g. by mounting auxiliary panels 24,26 to main panel 12, which is itself mounted on frame 18. One element for mounting auxiliary panels to frame 18 is illustrated in FIG. 2. A mounting bracket 30 includes a U-shaped portion 32 and an L-shaped portion 34 with vertical extension 40. U-shaped portion 32 is sized to accept a bottom edge of skirt 22, as illustrated in FIGS. 3A–B. A bolt 36, or other tightening componentry, is provided in U-shaped portion 32 to grip skirt 22. A plurality of notches 38 are provided along auxiliary panels 24,26.

Each notch 38 accepts the upper end of vertical portion 40 of a bracket 30 when an auxiliary panel is mounted in the horizontal orientation (FIG. 3A). It is contemplated that a plurality of brackets 30 will be disposed along major edges 14 and 16. Of course, notch 38 may be a single groove which extends along most or all of the length of auxiliary panel 24.

Brackets 30 further serve to support auxiliary panels 24,26 in a vertical configuration, as illustrated in FIG. 3B. Auxiliary panel 24 is slid into L-shaped portion 34 of bracket 30 and held vertically between vertical portion 40 and skirt 22.

Because standard table tennis tables frequently have a skirt 22, auxiliary panels 24,26 and brackets 30 can be provided as parts of a kit used to modify or retrofit a standard table tennis table to accommodate alternative games, such as table tennis with side rebound walls and doubles table tennis.

Figure 4A:
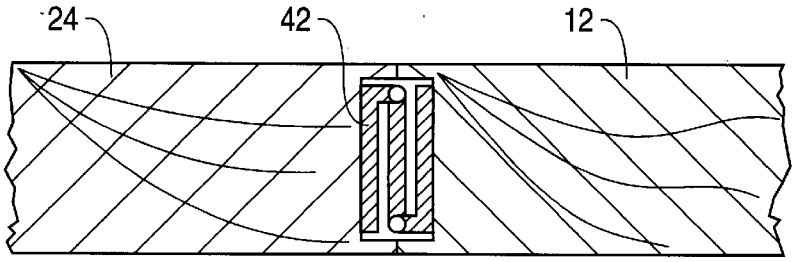
FIG. 4A is a cross-sectional view of an auxiliary panel mounted with a double acting hinge in the horizontal orientation.
Figure 4B:
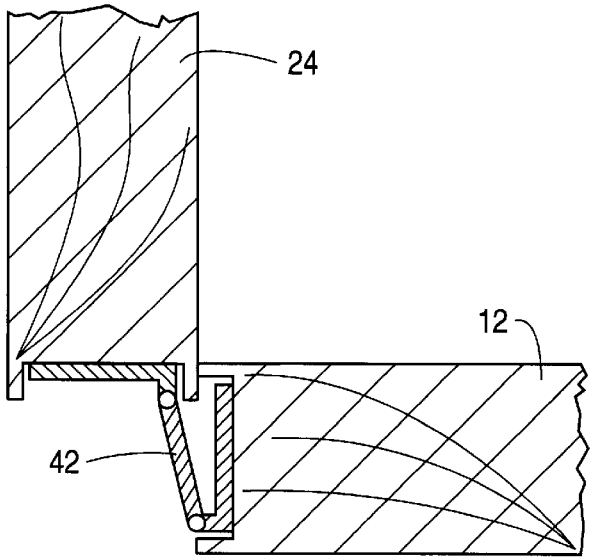
FIG. 4B is a cross-sectional view of an auxiliary panel mounted with a double acting hinge in the vertical orientation.
Figure 4C:
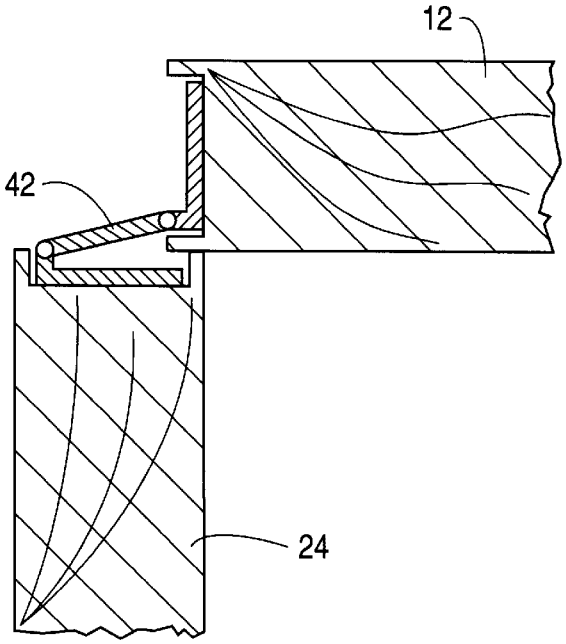
FIG. 4C is a cross-sectional view of an auxiliary panel mounted with a double acting hinge in the storage orientation.

Another element useful for mounting auxiliary panels 24,26 indirectly on frame 18 is a double acting hinge 42 mounted between auxiliary panels 24,26 and main panel 12. As illustrated in FIGS. 4A, B, and C, double acting hinge 42 holds auxiliary panel 24 in the horizontal, vertical, and storage positions, respectively, while maintaining the play surface free of gaps or ridges which could interfere with the direction of a rebounded ball. Preferably, a plurality of double acting hinges 42 are mounted along major edges 14 and 16.

A variety of mounting elements will be apparent to one skilled in the art. For example, auxiliary panels 24,26 may be provided with two perpendicular sets of bores, and the panels can be mounted to the frame using bolts or pins which extend into one of the sets of bores. One set of bores is used to mount the panel in the horizontal orientation, and the other set is used to mount the panel in the vertical orientation.

Figure 5A:
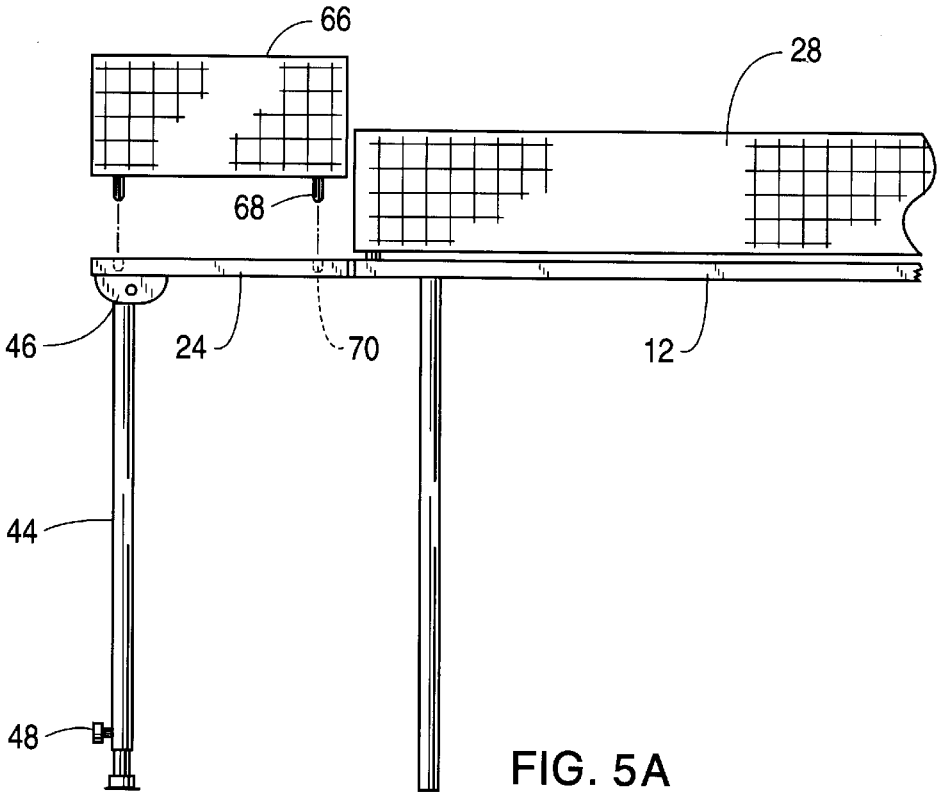
FIG. 5A is a side view of an auxiliary panel supported in the horizontal orientation with extendible legs.
Figure 5B:
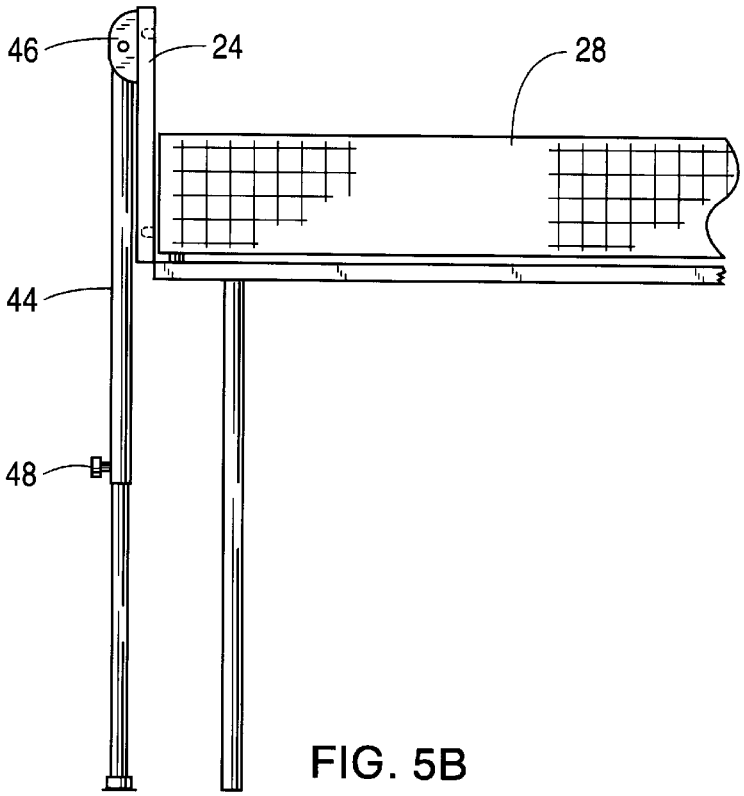
FIG. 5B is a side view of an auxiliary panel supported in the vertical orientation with extendible legs.

In order to hold auxiliary panels 24,26 in position, whether in the horizontal or vertical orientation, a bracing element is supplied to aid in supporting auxiliary panels 24,26. As illustrated in FIGS. 5A–B, leg 44 is mounted on auxiliary panel 24 at pivot 46. The length of leg 44 is adjustable in a telescopic fashion and can be held in one of two selected effective lengths with a latch 48. In the shorter of the effective lengths, illustrated in FIG. 5A, leg 44 supports panel 24 in the horizontal position. In the longer of the effective lengths, illustrated in FIG. 5B, leg 44 supports panel 24 in the vertical rebound position. Preferably, at least two legs 44 are provided on each one of auxiliary panels 24,26.

Figure 7:
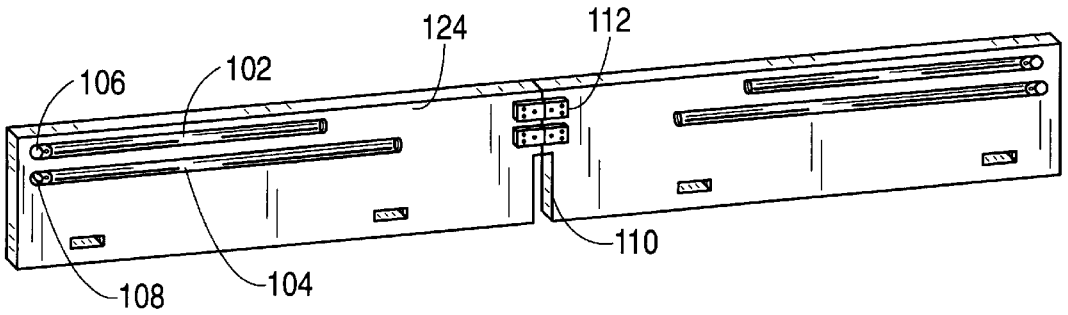
FIG. 7 is a perspective view of an alternative auxiliary panel.

As illustrated in FIG. 7, it is contemplated that as an alternative to legs with adjustable lengths, multiple legs with different lengths may be mounted on an auxiliary panel 124. Short leg 102 is mounted via a pivot 106 to panel 124, and long leg 104 is mounted to panel 124 via another pivot 108. Long leg 104 is extended to support panel 124 in the vertical rebound position, and short leg 102 is extended to support panel 124 in the horizontal position.

Figure 6A:
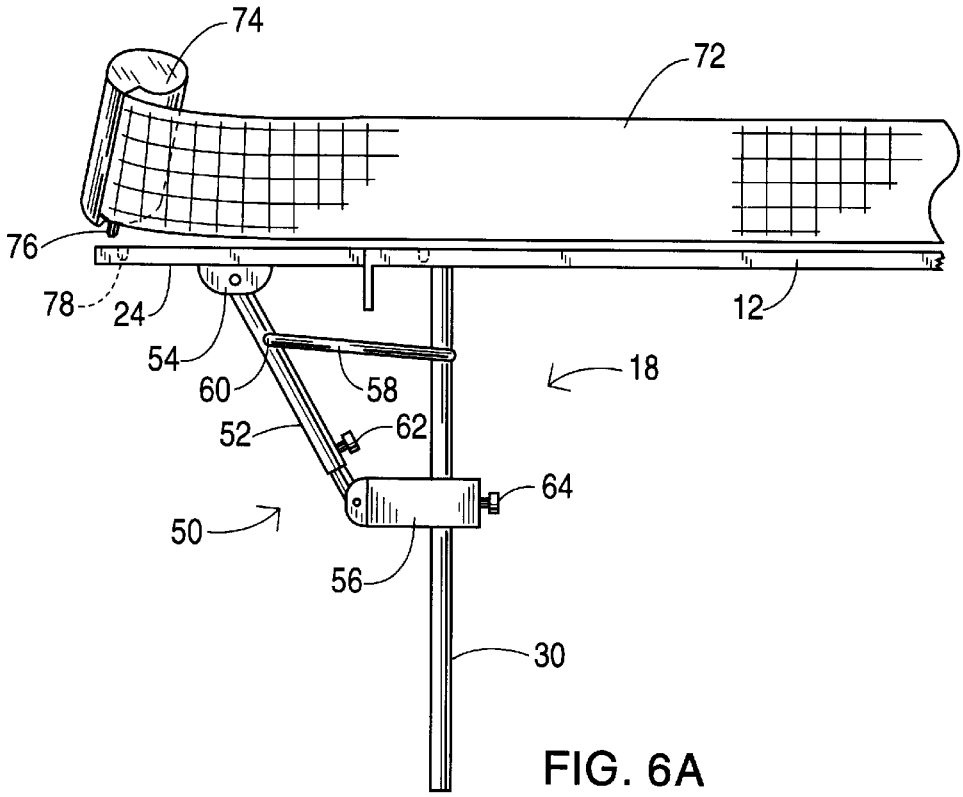
FIG. 6A is a side view of an auxiliary panel supported in the horizontal orientation with slidable linkage.
Figure 6B:
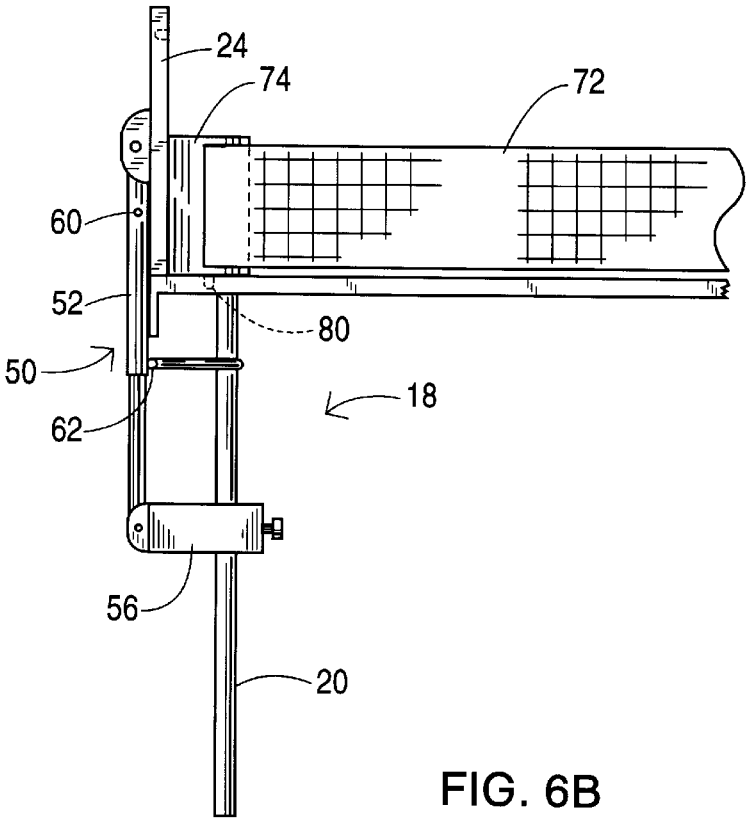
FIG. 6B is a side view of an auxiliary panel supported in the vertical orientation with a slidable linkage.

An alternative brace in the form of a slidable linkage 50 is illustrated in FIGS. 6A–B. Slidable linkage 52 includes telescoping strut 52 which is adjustable between two different lengths. Telescoping strut 52 is attached at one end to auxiliary panel 24 via pivot 54 and at the other end to frame 18 via pivoted bracket 56. Pivoted bracket 56 is attached to a leg 20 of frame 18 and held in position with a latch 64. A tension cord 58, such as a bungee cord, a rubber band, or a spring, attaches to telescoping strut 52 alternatively at an upper link 60 or a lower link 62. Tension cord 58 extends around leg 20 to aid in bracing auxiliary panel 24 by drawing telescoping strut 52 toward the frame.

Various additional braces will be apparent to one of ordinary skill in the art. For example, any of various multijointed connectors, such as locking snake connectors or double-joint arm connectors may be used to brace the auxiliary panels. One end of the multijointed connector is attached at least indirectly (i.e., directly or indirectly) to the frame, while another end is connected to the auxiliary panel. Preferably, at least two such connectors would be used for each auxiliary panel. Where the brace supplies sufficient support to the auxiliary panel without the use of a mounting element such as a bracket 30 or hinge 42, i.e. where the auxiliary panel is not displaced from a selected orientation during the course of ordinary play, the mounting element may be eliminated. Similarly, where the mounting element supplies sufficient support to the auxiliary panel without the aid of a bracket, the brackets may be eliminated.

When the auxiliary panels 24 are disposed in the horizontal orientation for doubles play, it is desirable to provide a net which extends all the way across the midline of the playing surface. As illustrated in FIG. 5A, with auxiliary panel 24 in the horizontal orientation, a net extension segment 66 with support pegs 68 is insertable in complementary recesses 70 of panel 24. As illustrated in FIG. 6A–B, an adjustable-length net 72 is dispensed from a net roll 74. Net roll 74 may be tensioned in the manner of an automatic tape measure to be biased to pull net 72 into net roll 74. Net roll 74 is provided with pegs 76 on a lower surface thereof. Pegs 76 fit alternatively into recess 78 on auxiliary panel 24 and recess 80 on main panel 12. For rebound play with auxiliary panel 24 in the vertical position, pegs 76 are fit into recess 80, while for doubles play with auxiliary panel 24 in the horizontal position, net 72 is pulled from net roll 74 to increase the length of net 72, and pegs 76 are fit into recess 78. Of course, various alternative configurations are available to adjust the length of the net, including simply providing two different nets with differing lengths, and replacing the shorter net with the longer net for doubles play.

In many existing table tennis tables, the net extends somewhat beyond the playing surface. In that case, when using an auxiliary panel in the vertical orientation as a rebound surface, it may be desirable to employ a panel 124 having a central notch 110 (FIG. 7). Notch 110 fits over the existing net and allows rebound play without changing the net. As an additional option, auxiliary panel 124 may be hinged with hinges 112 to allow panel 124 to be folded in half for less cumbersome storage and transport.

As mentioned above, a table tennis table can be modified to accommodate alternative games with the use of a kit including a pair of auxiliary panels such as panels 24,26, a mounting element such as brackets 30, braces such as legs 44, slidable linkages 50 or legs 102 and 104, and a net with variable length, such as net 72 or net 28 together with net extensions 66. In addition, such a kit may include a carrying case for all of the above items.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A table tennis table comprising:

a main panel defining a playing surface and having a primary length and a pair of opposing major edges;

a frame connected to said playing surface for supporting said playing surface in a horizontal orientation;

a pair of substantially rigid auxiliary panels each having a secondary length substantially equal to said primary length;

adjustable mounting elements mounting said auxiliary panels to said frame along respective ones of said major edges so that said auxiliary panels have a first orientation extending substantially perpendicularly relative to said main panel and upwardly from said main panel to form rebound surfaces and an alternate second orientation substantially coplanar with said main panel to laterally extend a playing surface of said main panel; and a table tennis net connected to said table along a midline thereof so that said net is oriented substantially perpendicularly to said playing surface.

2. The table tennis table defined in claim 1 wherein said net has a first length and an alternate second length longer than said first length, further comprising means for connecting said net to said table along a midline thereof so that said net is oriented substantially perpendicularly to said playing surface.

3. The table tennis table defined in claim 2, further comprising means connected to said net for maintaining said net in said adjusted lengths.

4. The table tennis table defined in claim 1, further comprising bracket means connected to said frame for attaching said auxiliary panels alternately in said first orientation and said second orientation.

5. The table tennis table defined in claim 4 wherein said bracket includes a pair of legs of different effective lengths, one length for supporting said auxiliary panels in said first orientation and another length in combination with said one length for supporting said auxiliary panels in said second orientation.

6. The table tennis table defined in claim 1 wherein said adjustable mounting elements include a plurality of brackets each connected at one end thereof to said frame and at an opposite end thereof to one of said auxiliary panels.

7. The table tennis table defined in claim 1 wherein said playing surface is provided with a downwardly depending skirt, said adjustable mounting elements including a plurality of brackets removably connected to said skirt, said adjustable mounting elements further including means on said auxiliary panels for cooperating with said brackets to support said auxiliary panels on said brackets.

8. The table tennis table defined in claim 7 wherein said brackets each include an L-shaped portion said means for cooperating are notches.

9. A kit for modifying a table tennis table including a main panel defining a playing surface and having a primary length and a pair of opposing major edges, said table further including a frame connected to said playing surface for supporting said main panel in a horizontal orientation, said kit comprising:

a pair of substantially rigid auxiliary panels each having a secondary length substantially equal to said primary length;

adjustable mounting elements for attaching said auxiliary panels and to said frame for mounting said auxiliary panels to said frame along respective ones of said major edges so that said auxiliary panels have a first orientation extending substantially perpendicular to and upwards from said playing surface to form rebound surfaces and an alternate second orientation substantially coplanar with said main panel to laterally extend said playing surface; and a net connectable perpendicular to said playing surface and extending transversely along a midline thereof.

10. The kit defined in claim 14 wherein said net can be adjusted to a first effective length to extend only across said playing surface when said auxiliary panels are in said first orientation and to a second effective length to extend across said playing surface and said auxiliary panels when said auxiliary panels are in said second orientation.

11. The kit defined in claim 10, further comprising means connected to said net for maintaining said net at said first and second lengths.

12. The kit defined in claim 9 wherein said adjustable mounting elements include a plurality of brackets each connected at one end thereof to said frame and at an opposite end thereof to one of said auxiliary panels.

13. A method for modifying a table tennis table to provide alternative games, said table tennis table including a main panel having a primary length and a pair of opposing major edges, said table further including a frame connected to said playing surface for supporting said playing surface in a horizontal orientation, said method comprising:

providing a pair of auxiliary panels each having a secondary length substantially equal to said primary length, and mounting said auxiliary panels said to frame along respective ones of said opposing major edges so that said auxiliary panels have a first orientation extending substantially perpendicularly relative to said playing surface and upwardly from said main panel to form rebound surfaces;

subsequently removing said auxiliary panels from said first orientation; and after removing said auxiliary panels from said first orientation, mounting said auxiliary panels to said frame along respective ones of said opposing major edges so that said auxiliary panels have a second orientation substantially coplanar with said playing surface to laterally extend said playing surface.

14. A method for modifying a table tennis table to provide alternative games, said table tennis table including a main panel defining a playing surface having a primary length and a pair of opposing major edges, said table further including a frame connected to said main panel for supporting said main panel in a horizontal orientation, said method comprising:

providing a pair of auxiliary panels each having a secondary length substantially equal to said primary length, and mounting said auxiliary panels to said frame along respective ones of said opposing major edges so that said auxiliary panels extend in a substantially coplanar configuration with said playing surface to form an extended playing surface for playing a table tennis game of doubles;

providing the extended playing surface with a net extending perpendicular upward from and transversely along a midline of said extended playing surface;

subsequently moving said auxiliary panels out of said coplanar configuration so that said main panel forms a conventional playing surface; and providing the table having the conventional playing surface with a shorter net extending perpendicular upwards and transversely along the mid-line across the conventional playing surface.

15. The method defined in claim 14 wherein the moving of said auxiliary panels includes shifting said panels to be substantially perpendicular relative to said playing surface and to extend upwardly from said main panel to form rebound surfaces.

* * * * *

UNITED STATES PATENT AND TRADEMARK OFFICE

CERTIFICATE OF CORRECTION

PATENT NO. : 5,833,559

DATED : November 10, 1998

INVENTOR(S) : Appelbaum and Wilk

It is certified that error appears in the above-identified patent and that said Letters Patent is hereby corrected as shown below:

Claim 1, lines 18-20, replace "a table tennis net connected to said table along a midline thereof so that said net is oriented substantially perpendicularly to said playing surface" with --a table tennis net connected perpendicular to said playing surface and extending transversely along a midline thereof--.

Claim 2, lines 2-6, replace "net has a first length ... said playing surface" with --net can be adjusted to a first effective length to extend only across said playing surface when said auxiliary panels are in said first orientation and to a second effective length to extend across said playing surface and said auxiliary panels when said auxiliary panels are in said second orientation--.

Claim 3, line 3, replace "net in said adjusted lengths" with --net at said first effective length and alternately at said second effective length--.

UNITED STATES PATENT AND TRADEMARK OFFICE

CERTIFICATE OF CORRECTION

PATENT NO. : 5,833,559

DATED : November 10, 1998

INVENTOR(S) : Appelbaum and Wilk

It is certified that error appears in the above-identified patent and that said Letters Patent is hereby corrected as shown below:

Claim 4, line 2, after "comprising" insert -- a--, and delete "means".

Claim 8, line 2, after "portion" insert --,-- (comma); line 3, change "are" to --being--.

Claim 9, line 11, delete "and" and after "said frame" delete "for mounting said auxiliary"; line 12, delete "panels to said frame".

Claim 10, line 1, replace "14" with "9".

Claim 13, line 3, after "panel" insert --defining a playing surface--; line 10, replace "said to" with --to said--.

Signed and Sealed this

Twenty-seventh Day of April, 1999

*Attest:*

Q. TODD DICKINSON

*Attesting Officer*

*Acting Commissioner of Patents and Trademarks*